United States Patent [19]

Perotti

[11] Patent Number: 4,612,786

[45] Date of Patent: Sep. 23, 1986

[54] LATCH-TYPE NEEDLE FOR TRANSFERRING STITCHES

[75] Inventor: André Perotti, Couvet, Switzerland

[73] Assignee: Edouard Dubied & Cie. S.A., Couvet, Switzerland

[21] Appl. No.: 807,737

[22] Filed: Dec. 11, 1985

[30] Foreign Application Priority Data

Dec. 18, 1984 [CH] Switzerland ..... 5994/84

[51] Int. Cl.[4] ..... D04B 35/04

[52] U.S. Cl. ..... 66/121; 66/123

[58] Field of Search ..... 66/123, 121, 95, 111, 66/24, 70

[56] References Cited

U.S. PATENT DOCUMENTS 2,146,079 2/1939 Kunzmann ..... 66/95

2,397,456 3/1946 Sirmay ..... 66/95 X 2,626,515 1/1953 St. Pierre ..... 66/123

*Primary Examiner*—Ronald Feldbaum

*Attorney, Agent, or Firm*—Lewis H. Eslinger

[57] ABSTRACT

A latch-type needle for transferring stitches has a needle shank and lateral clip that define a space, and the shank and clip are each provided with an oppositely arranged protrusion that extend into the defined space. In a stitch transfer operation between a so-called reporting and a so-called receiving needle a closed latch of the receiving needle is lifted and opened by interaction between the latch spoon of the receiving needle and the inner protrusions of the needle shank and clip of the reporting needle, whereby smooth opening of the latch during stitch transfer is accomplished.

6 Claims, 5 Drawing Figures

LATCH-TYPE NEEDLE FOR TRANSFERRING STITCHES

BACKGROUND OF THE INVENTION

1. Field of the Invention

This invention relates generally to a latch-type needle for transferring stitches used in a knitting machine and, more particularly, to a latch-type needle that enables simultaneous stitch formation and transfer when used in a knitting machine with opposite needle beds.

2. Description of the Background

In order to use known latch-type needles, which permit simultaneous stitch formation and transfer in knitting machines having opposite needle beds, special latch openers are required. These known latch openers may be in the form of brushes, wire hooks, magnets, and other similar devices, and are necessary to open the latches in the direction of the needle shank when the needles are empty, that is, when the needles have not been provided with stitches. All of these heretofore known latch-opening devices, however, have at least one disadvantage in that because of the accuracy with which they must be set up, they tend to malfunction easily. Consequently, these known latch-opening devices do not reliably enable perfect openings of the needle latches.

In the case of knitting machines that are fitted with latch-type needles for transferring stitches, such as shown in German Patent Publication No. DE-OS 2443 231, the latches of the receiving needles are opened automatically by means of the actual stitches themselves that are to be transferred. Nevertheless, this method provides extreme difficulties of operation when used with yarns that consist of several different threads, because the threads are easily divided.

Still another kind of latch-type needle used for direct transfer of stitches, is known for example in German Patent Publication No. DE-AS 1.585.391 in which a closed latch on the needle is opened by a feed motion from a stopper element that is located at the rear of the needle shank of the opposite needle. The problem with this solution is that because the opposite needles are required to have special positions, then stitches can not be formed and transferred simultaneously.

OBJECTS AND SUMMARY OF THE INVENTION

Accordingly, it is an object of the present invention to provide a latch-type needle for transferring stitches that can eliminate the above-noted defects inherent in the prior art.

Another object of this invention is to provide a latch-type needle for transferring stitches that can open a closed latch of the receiving needle by means of the reporting needle, yet still eliminate disadvantages present in such systems heretofore known.

A further object of this invention is to provide a latch-type needle for transferring stitches in which a lateral clip is provided on the needle shank to form a space and wherein to a protrusion is formed on both the lateral clip and the needle shank to extend into the defined space, thereby to open a closed latch during stitch transfer.

In accordance with an aspect of the present invention, a latch-type needle is formed with a needle shank and a lateral clip, spaced apart from the needle shank to define a space therebetween. A protruding element is formed on each of the needle shank and clip at the corresponding location, so as to form a narrowed opening. The so-called reporting needle then passes into the defined space of the so-called receiving needle and the latch spoon on the reporting needle is actuated to open the latch that had been previously positioned over the needle hook.

The above and other objects, features, and advantages of the present invention will become apparent from the following detailed description of illustrated embodiments thereof to be read in conjunction with the accompanying drawings, in which like reference numerals represent like or similar elements.

DETAILED DESCRIPTION OF PREFERRED EMBODIMENTS

Figure 1:
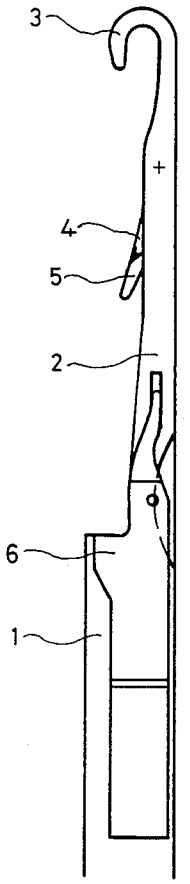
FIG. 1 is a front elevational view of a latch-type needle according to the present invention.
Figure 2:
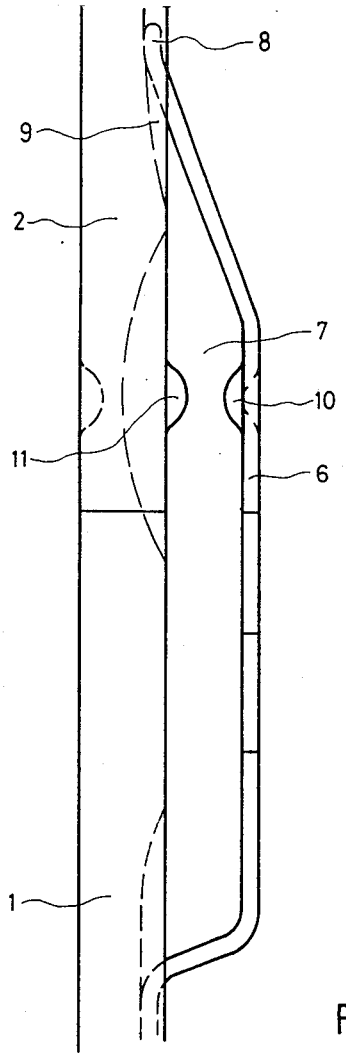
FIG. 2 is a side elevational view of the needle of FIG. 1 showing a portion thereof enlarged.

FIGS. 1 and 2 represent a latch-type needle 1 according to the present invention comprising an elongated needle shank 2, a needle hook 3, and a hinged or pivoted latch 4. Latch 4 is provided with a latch spoon 5 at its exposed or free end. A clip element 6 is attached to needle shank 2 in the conventional fashion and in cooperation with needle shank 2 forms a space or open slot 7. Clip 6 is formed having a free end 8, which is supported in a groove 9 formed in needle shank 2.

According to the present invention a protrusion 10 is formed on clip 6 that extends inwardly into space 7 that has been formed between clip 6 and needle shank 2. Located directly opposite protrusion 10 is a similar protrusion 11, which is, in substance, symmetrically arranged to protrusion 10. Protrusion 11 also extends into space 7 that is defined by clip 6 and needle shank 2.

Protrusions 10 and 11 are dimensioned relative to clip 6 and shank 2 and space 7, so that the distant between the opposing protrusions 10 and 11 is greater than the thickness of needle hook 3, yet is smaller than the width of latch spoon 5.

Figure 3:
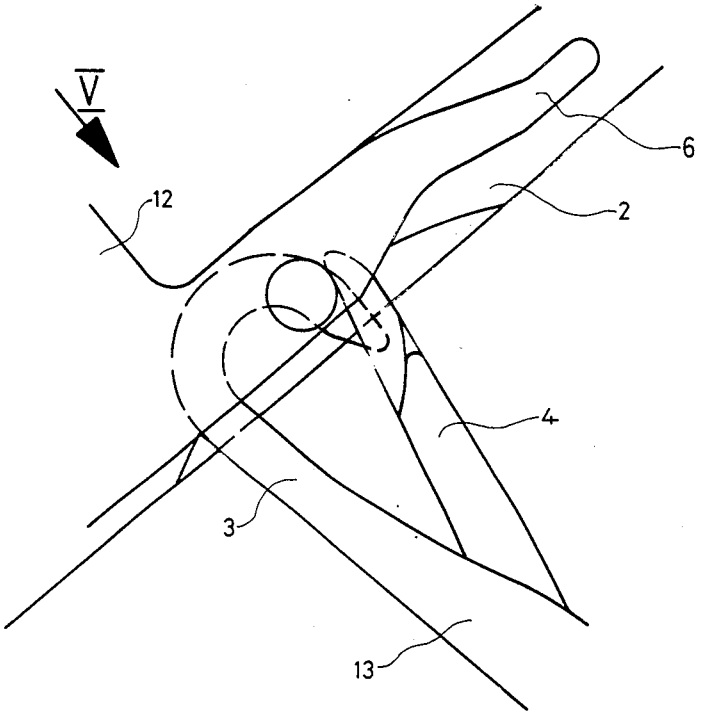
FIG. 3 is a plan view of the needle according to the present invention representing a stitch transfer operation with a latch in the closed position.
Figure 4:
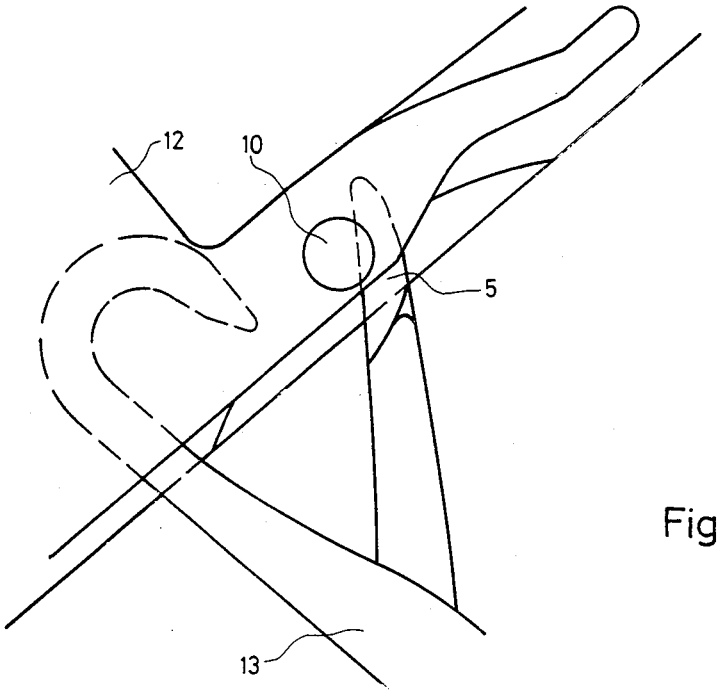
FIG. 4 is a view similar to FIG. 3 in which the needle hook of the receiving needle is being opened by moving the latch spoon.

Turning now to FIG. 3 the operation of the present invention is described. If in FIG. 3 it is assumed that needle 12 is the so-called reporting needle and is transferring a stitch that has already been driven out and the needle hook 3 of the receiving needle 13, whose latch 4 is closed, has entered space 7 formed between needle shank 2 and clip 6 of the reporting needle 12. Then, as the needles 12 and 13 are driven out further, latch spoon 5 enters into the narrowed space defined by protrusions 10 and 11 and latch spoon 5 is lifted by protrusions 10 and 11, thereby opening the latch.

Figure 5:
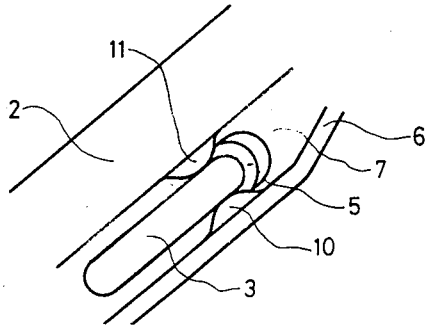
FIG. 5 is a side elevational view, similar to FIG. 2, showing the needle hook of the receiving needle and the latch spoon of the reporting needle in operation, as shown at arrow V of FIG. 3.

One advantage of the present invention is seen in FIG. 5, in that protrusions 10 and 11 allow needle hook 3 to penetrate space 7 cleanly, yet they grab onto the sides of latch spoon 5. Thus, a smooth and controlled opening of closed latches occurs when transferring stitches to so-called "empty" needles.

In regard to manufacture of the present invention, protrusion 10 and 11 can be formed of the same material as their respective principal elements, that is, clip 6 and shank 2, by impression or embossing. Nevertheless, protrusions 10 and 11 can also be formed of separate elements inserted into complimentary holes and may comprise bolts or pins or the like.

The above description is provided for various preferred embodiments of the invention, however, it will be apparent that many modifications and variations could be effected by one skilled in the art without departing from the spirit or scope of the novel concepts of the invention, which should be determined only by the appended claims.

What is claimed is:

1. An improved latch-type needle for transferring stitches, of the kind having a needle shank, a needle hook, a latch, and a rigid, lateral clip arranged proximate said needle shank and defining a space therebetween for use in stitch formation and transfer in a knitting machine having opposite needle beds, the improvement comprising a first protrusion formed on the needle shank and a second protrusion formed on the clip, said first and second protrusion extending into the defined space between the clip and the shank to cooperate with the latch to open a closed latch during transfer of stitches from a needle to needle.

2. A latch-type needle according to claim 1, wherein said first and second protrusions are, in substance, arranged symmetrically in the defined space and located exactly opposite one another, whereas a distance between said first and second protrusions is less than a width of the latch and greater than a thickness of a needle hook.

3. A latch-type needle according to claim 2, wherein the protrusions are cambered.

4. A latch-type needle according to claim 3, wherein said first and second protrusions are embossed and formed by impressions made in a wall material of the respective shank and clip.

5. A latch-type needle according to claim 3, wherein said first and second protrusions are formed on the respective shank and clip by means of bolts.

6. A latch-type needle according to claim 3, wherein said first and second protrusions are formed on the respective shank and clip by means of pins.

* * * * *